United States Patent [19]

Ohkawa

[11] 4,035,656

[45] July 12, 1977

[54] METHOD AND APPARATUS FOR USE IN APPROACHING THERMONUCLEAR TEMPERATURES USING TURBULENT THERMAL INSULATION

[75] Inventor: Tihiro Ohkawa, La Jolla, Calif.

[73] Assignee: General Atomic Company, San Diego, Calif.

[21] Appl. No.: 581,148

[22] Filed: May 27, 1975

[51] Int. Cl.[2] ..... G21G 4/02

[52] U.S. Cl. ..... 250/500; 250/499

[58] Field of Search ..... 250/499, 500, 501

[56] References Cited

U.S. PATENT DOCUMENTS

| | | | |
|---|---|---|---|
| 3,117,912 | 1/1964 | Imhoff et al. | 250/500 X |
| 3,338,789 | 8/1967 | Fink | 250/499 X |
| 3,526,575 | 9/1970 | Bennett | 250/500 X |
| 3,864,640 | 2/1975 | Bennett | 250/500 X |

*Primary Examiner*—Archie R. Borchelt
*Attorney, Agent, or Firm*—Fitch, Even, Tabin & Luedeka

[57] ABSTRACT

A method and apparatus is disclosed for insulating a plasma using turbulent thermal insulation for the purpose of approaching thermonuclear temperatures. It includes a hollow cylinder of a metallic hydride of predetermined size which is encapsulated by an outer metallic cylinder which seals the hollow cylinder, including the ends thereof. A mixture of deuterium and tritium gas is placed within the hollow cylinder at a pressure of about 1½ atmospheres and auxiliary and main power supplies are sequentially applied to the cylinders to respectively form a plasma and inject an electron beam into the plasma. The thermal conductivity is reduced by the resulting electron turbulence.

21 Claims, 5 Drawing Figures

METHOD AND APPARATUS FOR USE IN APPROACHING THERMONUCLEAR TEMPERATURES USING TURBULENT THERMAL INSULATION

The present invention generally relates to nuclear fusion technology and, more specifically, to a method and apparatus for use in approaching thermonuclear temperatures that would enable a fusion reactor to achieve net energy production.

For a nuclear fusion reactor to produce energy, it is necessary for the plasma to be thermally insulated from the surrounding area for a sufficient period of time that the Lawson criterion is satisfied. The Lawson criterion is generally expressed in the form of the equation $n\tau \geqslant 10^{14}$ cm$^{-3}$ sec. where $\tau$ is the confinement time of the plasma. Generally speaking, the confinement of the plasma has taken two different types of approaches, one of which is magnetic confinement which relies on the magnetic field to reduce the thermal transport while the other approach relies upon the inertial confinement of the particles in a vacuum. There have also been several methods that use a gas for providing thermal insulation. In these proposed methods, the particles are not confined but the thermal conductivity of electrons is to be reduced by applying a modest magnetic field. For a plasma where the heat is confined but not the pressure, the required temperature for breakeven is higher than the case of pressure confined plasmas because of increased Bremsstrahlung loss. With a parabolic temperature profile, the required temperature is about three times higher.

It is an object of the present invention to provide the method and apparatus for reducing the thermal conductivity by using electron turbulence as the means for thermally insulating the plasma so that thermonuclear temperatures can be approached.

Other objects and advantages of the present invention will become apparent upon reading the following detailed description while referring to the attached drawings in which.

Figure 1:
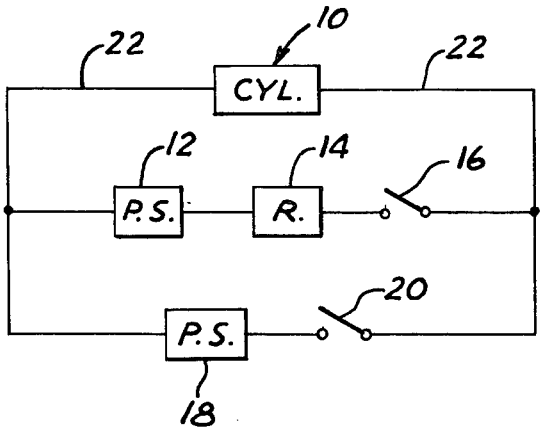
FIG. 1 is a schematic diagram of apparatus that is useful in practicing the method of the present invention.

Turning now to the drawings and particularly FIG. 1, there is shown a schematic diagram of apparatus that is useful in practicing the method of the present invention and also illustrates the apparatus, indicated generally at 10, embodying the present invention which is shown together with other equipment which supply energy to the apparatus 10. More specifically, an auxiliary power supply 12, a resistance 14 and a normally open switch 16 are series connected to the apparatus. A main power supply 18 and switch 20 are connected in parallel with the auxiliary power supply. The power supplies are each connected across the opposite ends of the apparatus 10 and are adapted to apply substantial amounts of energy to the apparatus upon closing the respective switches.

Figure 2:
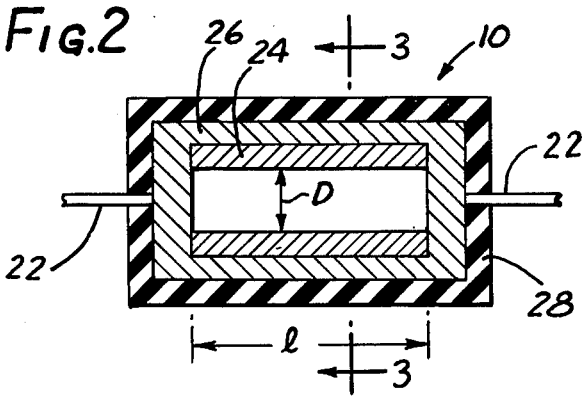
FIG. 2 is a cross section of a portion of the apparatus illustrated schematically in FIG. 1.
Figure 3:
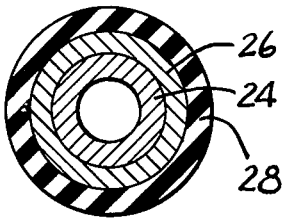
FIG. 3 is a total cross section of the apparatus shown in FIG. 2 and taken generally along the line 3—3.

Referring to the apparatus 10 shown in detail in FIG. 2, it comprises a hollow cylinder having an inside diameter D and a length $l$ with the cylinder 24 preferably being made of a metallic hydride, such as lithium deutride. The inside diameter D is on the order of about 6 millimeters and the length $l$ is about 1 centimeter. The cylinder 24 is preferably enclosed in a cylinder 26 having closed ends that is preferably comprised of lithium. The wires 22 are attached to the ends of the metal cylinder 26 and the space within the ends of the cylinder 26 and the inside of the hollow cylinder 24 preferably contains a gaseous mixture of a hydrogen isotope having an atomic weight greater than one, such as deuterium and tritium, at a pressure of about 1.5 atmospheres. The outer cylinder 26 is then encased in either a liquid or solid insulating material 28.

For a fusion reaction to occur, the plasma must be produced and also thermally insulated from the surroundings for a period of time that is long enough to produce a substantial amount of neutrons and is given by the Lawson criterion expressed in terms of the equation $n\tau \geqslant 10^{14}$ cm$^{-3}$ sec. where $\tau$ is the confinement time and $n$ is the particle number density of the plasma. To generate the plasma, the auxiliary power supply 12 is fired across the apparatus 10 by closing the switch 16 which may be an exploding wire type of switch. The power supply 12 is preferably capable of supplying about 5,000 joules of energy at about 50,000 volts with the series impedance 14 being only a few ohms. The purpose of the auxiliary power supply is to create a plasma within the cylinder 24 and it has been demonstrated that the exploding wire technique can produce a plasma current in about 100 nanoseconds. The extremely high current that is generated in the metallic cylinder 26 causes it to rapidly heat up and vaporize which then results in the conductivity dropping to zero. At this time a high voltage will then appear across the gaseous mixture and the plasma current is built up. The main power supply 18 is then applied for the purpose of producing an electron beam at a high energy in the plasma. To this end, the power supply 18 should have a stored energy of about 100,000 joules which is applied at a voltage of about 600,000 volts with a rise time characteristic of $10^{-7}$ seconds and the duration of a few microseconds in a manner similar to Blume line type power supplies.

Figure 4:
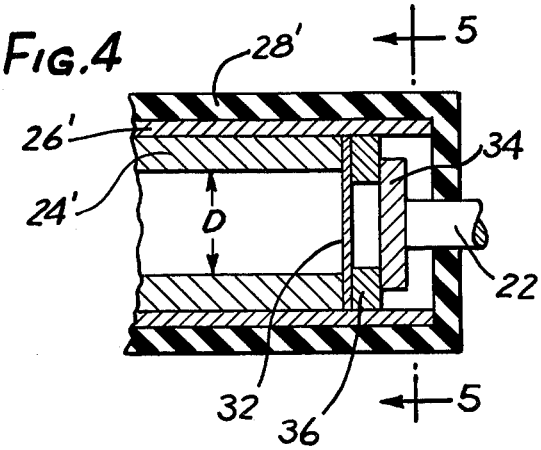
FIG. 4 is a cross section of a portion of a modified apparatus that is similar to the apparatus of FIG. 2.
Figure 5:
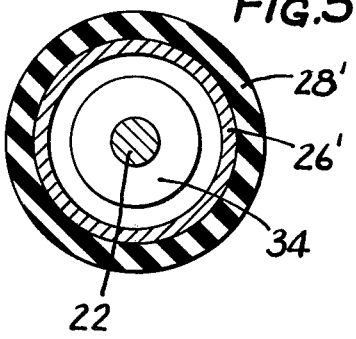
FIG. 5 is a total cross section of the apparatus shown in FIG. 4 and is taken generally along the line 5—5 of FIG. 4.

As will be more fully explained herein, the application of the high voltage from the main power supply 18 is intended to produce an electron beam at a high energy in the plasma and should not merely increase the plasma current. Accordingly, it may be necessary to use a semiconductor or insulator for the material used for the cathode, i.e., the ends of the metal cylinder 26 where the lines 22 are attached. Alternatively, in referring to FIGS. 4 and 5, the hollow cylinder 24′ which is similar to the hollow cylinder 24 and also has an inside diameter D, may be enclosed by a metallic cylinder 26′ which has only one closed end portion that is integrally formed therein. The other end has a relatively thin conductive foil member 32 that is positioned adjacent the one end of the hollow cylinder 24′ and seals that end. The line 22 is connected to a cathode 34 and the outside periphery of the cathode 34 is preferably spaced from the metallic cylinder 26′ as well as from the foil 32 by an angular insulator 36.

As previously mentioned, for approaching thermonuclear temperatures that would enable a fusion reactor to achieve the net energy production, it is necessary for the plasma to be thermally insulated from the surroundings for a predetermined period of time which is determined by the Lawson criterion. The method of the present invention reduces the thermal conductivity, or stated in other words, thermally insulates the plasma from the surrounding area through the use of electron turbulence. Electrons conduct heat by the process whereby hot electrons escape into the colder region and give up energy to colder electrons through collisions. The kinetic thermal conductivity is broadly given by the equation $$D = v_e^2/\nu \tag{1}$$

where $v_e$ is the electron thermal velocity and $\nu$ is the collision frequency. It is noted that the kinetic thermal conductivity given by the equation assumes that the effects of ambipolar potential and the distortion of the electron distribution function are neglected. Since the collision frequency decreases as the three halves power of temperature, the thermal conductivity increases as the five halves power of temperature.

The energy confinement time $\tau_E$ is given by $$\tau_K = \frac{r^2}{D} = \frac{\nu r^2}{v_e^2} \tag{2}$$

where $r$ is the size of the radius of the plasma.

The $n\tau_E$ value is then given by $$n\tau_K = \frac{\nu n r^2}{v_e^2} \tag{3}$$

The break-even condition, above which level a net production of energy occurs, is $$n\tau_K \geqslant 10^{20} \mathrm{m}^{-3}\mathrm{sec} \tag{4}$$

at a temperature above 30 keV which then becomes $$nr \geq \frac{v_e}{\sqrt{\nu/n}}\, 10^{10}\, m^{-2} \tag{5}$$

At a thermonuclear temperature of 30 keV, this equation becomes $$nr \geqslant 6 \times 10^{25}\, m^{-2} \tag{6}$$

This is to be compared with the condition for the inertial confinement condition given by $$nr \geqslant 10^{26}\, m^{-2} \tag{7}$$

The two conditions are similar except that the scaling is different. The value given by equation (6) scales as the square root of the $n\tau$ value while the value in the inertial confinement condition in equation (7) is linear.

If the thermal conductivity is reduced from the classical value, the break-even condition becomes easier to reach. It is known that the turbulent electric field will reduce the thermal conductivity by making the electron mean-free path shorter.

If the case is considered where the plasma electrons are fully turbulent, the wavelength down to the Debye length $\lambda_D$ is fully excited and the amplitude of the potential fluctuation is of the order of electron temperature ($T/e$). The Debye length is generally defined as the distance in which electrostatic disturbances of the plasma are shielded by electrons. The time scale of the waves is $\omega_p^{-1}$, where $\omega_p$ is the plasma frequency. Under these conditions, the effective collision frequency $\tilde{\nu}$ of the electron-wave collision is given by $$\tilde{\nu} \approx \alpha\omega_p = \alpha\sqrt{\frac{e^2 n}{m_e \epsilon_o}} \tag{8}$$

where $\alpha$ is a numerical constant. The kinetic thermal conductivity is given by $$D = \frac{v_e^2}{\tilde{\nu}} = \frac{v_e^2}{\alpha\omega_p} \tag{9}$$

and the break-even condition then becomes $$nr \geqslant 0.7\, \alpha^{-1/2}\, n^{1/4} \times 10^{17}\, m^{-2} \tag{10}$$

This is easier to satisfy than the value previously shown in Equation (5).

The ion thermal conductivity is also reduced by the turbulence. An ion encountering a wave pocket receives a momentum of $(e\phi/\lambda_D) \times \omega_p^{-1}$, where the mass of the packet $m_e\, n\, \lambda_D^3\, (e\phi/T_e)$ is assumed to be much larger than the ion mass. The frequency of the ion-packet encounter is $v_e/\lambda_D = \omega_p$. Therefore the effective collision frequency is given by $$\tilde{\nu} \approx \alpha\omega_p \left(\frac{m_e v_e}{m_i v_i}\right)^2 \approx \tilde{\nu}_e \frac{m_e}{m_i} \tag{11}$$

where $e\phi \approx T_e$ has been assumed.

The ion thermal conductivity $D_i$ is then given by $$D_i = \frac{v_i^2}{\tilde{\nu}_i} \approx D_e\,. \tag{12}$$

which means that the ion contribution is about the same as the electron contribution.

The turbulent equipartition time $\tilde{\tau}_{eq}$ between electrons and ions is given by $$\tilde{\tau}_{eq} = \alpha^{-1}\, \omega_p^{-1} (m_i/m_e) \tag{13}$$

The ratio of the confinement time $\tau_E$ and the equipartition time is then given by $$\tau_K/\tilde{\tau}_{eq} = \alpha^2 \left(\frac{r}{\lambda_D}\right)^2 \frac{m_e}{m_i}\,. \tag{14}$$

If this ratio is much larger than unity, the electron and ion temperature stay close.

With respect to the electric resistivity and skin time considerations, the turbulent resistivity $\eta$ is given by $$\tilde{\eta} = \frac{m_e \tilde{\nu}}{e^2 n} = \frac{\alpha m_e \omega_p}{e^2 n} = \frac{\alpha}{\omega_p \epsilon_o} \tag{15}$$

The skin time $\tau_{skin}$ is then $$\tau_{skin} = \mu_o r^2 \tilde{\eta}^{-1}$$

-continued $$= \frac{\omega_p}{\alpha}\left(\frac{r}{c}\right)^2. \quad (16)$$

Comparing the skin time with the energy confinement time, the following relation is obtained $$\tau_{skin}/\tau_E = \frac{v_e^2}{\alpha^2 c^2} << 1 \quad (17)$$

Turning now to magnetic and plasma energy considerations, a cylindrical plasma of radius $r$ is assumed. The current I through the plasma will produce the magnetic field $B_\theta$ at the edge of the plasma given by $$B_\theta = \frac{\mu_o I}{2\pi r}. \quad (18)$$

If the plasma is heated by turbulent Ohmic heating, the current is calculated, by equating the energy loss and the energy input, i.e., $$nT \sim (I/\pi r^2)^2 \tilde{\eta} \times \tau_E \quad (19)$$

Then the $\beta$ of plasma is given by $$\beta = 2\mu_o nT/B_\theta^2 = 8\alpha^2 c^2/v_e^2 \quad (20)$$

For $\alpha \sim 1$, then $\beta >> 1$ and the magnetic effects are not important for dynamics.

However, if the current is due to an electron beam and the beam is supplying all the energy, we have $$I_b = \frac{3enT\pi r^2 \times l}{W_b \tau_E}. \quad (21)$$

The beam current is limited by the Alfven - Budker condition given by $$I_b \leq 10^4 \text{ Amp } (v_b/c)[1-(v_b/c)^2]^{1/2} \quad (22)$$

By combining this equation (22) with equation (21), the following is obtained $$(W_b/m_o c^2)^2 \geq 2 \times nT \cdot l\, \lambda_D\, v_e \times 10^{-9} \quad (23)$$

By using the value of beam energy of $l/\lambda_D$ (see equation 40 herein) the following is obtained $$\beta = \frac{8r^2}{l^2}\ \frac{c^2}{v_e^2}\left(\frac{l}{\lambda_D}\right)^{2/5} >> 1. \quad (24)$$

It should also be understood that the pressure of plasma has to be contained ultimately either by the inertial effect or by a mechanical container, although in the hot region of plasma the pressure is isotropic because of $\nabla n/n = -\nabla T/T$. For a thermonuclear plasma with $n > 10^{24}\ m^{-3}$, the mechanical container is not sufficiently strong and the containment has to be inertial. Since the mass is concentrated in the outer cold region, the expansion velocity is roughly the sound velocity $v_s$ in the cold region or the sound wave velocity of the material wall. The containment time is given by $$\tau_c = r_c v_s = r_c\sqrt{m_i/T_c} \text{ for plasma} \quad (25)$$

where $r_c$ is the outer radius of the plasma and $T_c$ is the temperature at the outer edge. It should be realized that the containment time $\tau_c$ has to be much larger than the energy confinement time $\tau_E$.

The internal energy of the plasma comprises the thermal energy and the energy in the wave. The energy in a wave is given by $n\lambda_D^3 e\phi$ and there are $\lambda_D^{-3}$ waves in a unit volume. Therefore the wave energy is comparable with thermal energy, if $e\phi \sim T_e$ and the total energy density is given by $(9/2)n$T.

If a cylindrical plasma with radius $r$ and the length $l$ is considered, the total energy W is given by $$W = (9/2)nT\,\pi r^2(l/r). \quad (26)$$

By using Eq. (10), the total energy becomes $$W \geq 5T(l/r)\alpha^{-3/2}n^{-5/4}\ 10^{51}\ \text{J}. \quad (27)$$

At a thermonuclear temperature, $T = 10$ keV, then the total energy is $$W \geq 8 \times 10^{36}(l/r)\alpha^{-3/2}n^{-5/4}\ J. \quad (28)$$

For example, if the ratio $(l/r) = 3$, $\alpha \sim 1$ and $n = 10^{26}$ $m^{-3}$, the minimum energy required and the minimum radius are $$W \sim 7 \times 10^4\ J. \quad (29)$$
$$r \sim 2.5 \times 10^{-3}\ m. \quad (30)$$

In keeping with the present invention, and considering the situation where an electron beam is injected to a plasma, a two-stream instability will occur and plasma waves will grow. The maximum growth is near $\omega_{pe} = kv_b$ where $\omega_{pe}$ is the electron plasma frequency, $k$ is the wave number and $v_b$ is the electron velocity of the beam. The growth rate $\lambda$ is roughly $\lambda \sim \omega_{pe}(n_b/n_o)^{1/3}$ when $n_o$ is the plasma density and $n_b$ is the beam electron density. As the amplitude of waves grows, nonlinear electron density. As the amplitude of waves grows, nonlinear effects will take over. The wave to wave coupling will spread the spectrum in the $k$ space. Since the waves of short wavelength $k\lambda_D > 1$ are heavily damped (where $\lambda_D$ is the Debye length), the spectrum between $\omega_{pe}v_b^{-1} < k < \lambda_D^{-1}$ is filled. The ion waves may be also excited. The main process involves the excitation of sound waves through non-linear interactions by plasma waves. Meanwhile, the plasma will be heated through the particle-wave interaction, as has been observed in the turbulent heating experiments.

The energy flow is from the beam to the waves and then to the thermal energy of the plasma. If it is assumed that the plasma loses its heat by conduction, a steady state will be reached when the fluctuation level and the plasma temperature adjust themselves to make the energy throughput equal between various phases.

The energy loss rate of the beam due to the interaction with the wave of the amplitude $\phi_k$ is given by $$\frac{dW_b}{W_b dt} = \left(\frac{e\phi_k}{W_b}\right)^2 kv_b \quad (31)$$

where $W_b$ is the beam electron energy, $v_b$ is the velocity of the beam electron. By using $kv_b = \omega_{pe}$, then $$\nu_b \equiv \frac{1}{W_b}\frac{dW_b}{dt} \approx \left(\frac{e\phi_k}{W_b}\right)^2 \omega_{p_e}. \quad (32)$$

For the wave-wave interaction, a simple model is used where the wave packets of wavenumber $k$ and of the group velocity $v_g$ collide and exchange energy and momentum. The self-collision frequency $\nu_{kk}$ is given by $$\nu_{kk} \approx \left(\frac{e\phi_k}{T}\right)^2 \omega_{p_e}/(k^2\lambda_D^2). \quad (33)$$

The energy equalization frequency between the wave with wavenumber $k$ and the wave with wavenumber $\lambda_D^{-1}$ is given by $$\nu_{k\lambda_D^{-1}} \approx \frac{e^2\phi_k\phi_{\lambda_D^{-1}}}{T^2}\omega_{p_e}\cdot k^4\lambda_D^4. \quad (34)$$

By using $kV_b = \omega_p$ and assuming $\phi_{\lambda_D^{-1}} \sim \phi_k$, then $$\nu_{k\lambda_D} = \left(\frac{e\phi_k}{T}\right)^2 \omega_{p_e}\left(\frac{T}{W_b}\right)^2 \approx \nu_b. \quad (35)$$

This indicates that the spectrum of $\phi_k$ is rather flat between $\omega_p/v_b$ and $\lambda_D^{-1}$. The wave with $k\lambda_D > 1$ is heavily damped. Therefore the beam energy is fed into the thermal energy of plasma. The energy balance is given by $$n_b W_b \nu_b \approx nT/\tau_E. \quad (36)$$

By using $$\tau_E = \left(\frac{e\phi}{T}\right)^2 r^2\omega_{p_e}/v_e^2 \quad (37)$$

then $$(e\phi/T)^4 = \lambda_D^2/r^2\,(Wn/Tn_b). \quad (38)$$

It is preferred that parameters be chosen to achieve $e\phi \sim T$, and such is not difficult.

Since the hot region of plasma is the region of the smallest density, the plasma wave will not propagate out to the cold region where the plasma frequency is higher. Therefore the electron turbulence is confined to the hot region.

The ion waves do not couple very well with the beam, unlike the case where the plasma electrons are absent. The sound wave is excited by nonlinear interactions of the electron plasma waves instead. The growth rate $\tau$ is given roughly by $$\gamma \approx \left(\omega_{p_e}\omega_s\frac{e^2\phi^2_k}{T_e^2}\right)^{1/2} \quad (39)$$

where $\omega_s$ is the sound wave frequency. After the buildup the equilibrium will be reached between the plasma waves, the sound wave, and the plasma ions. A sound wave of long wavelength is more effective for transporting the energy. However, the number of waves per unit volume is $k^3$ and the overall energy transport is mainly by the waves of short wavelength. The transport rate is then comparable to the transport due to ions given by Equation (12).

If a cylindrical configuration is used, the end effects become important. Considering a cylindrical plasma placed between the anode and the cathode which is the emitter of high energy electrons. The pressure balance may be obtained by having a high density near the electrodes. The beam energy may be selected in such a way that it does not quite reach the anode. The condition is given by $$(W_b/T)^{5/2} = l/\lambda_D. \quad (40)$$

The plasma near the anode then stays cold and nonturbulent and behaves more or less like the plasma at the outer radius. Near the cathode, the beam will excite the waves in the dense plasma. The resultant heat will be lost to the electrode. The thickness $d$ of the region where the thermal conduction dominates over the dynamic motion, is given by $$d = \sqrt{\frac{m_i}{m_e}}\,\lambda_D. \quad (41)$$

The energy expended by the beam in the region is wasted to heat the cathode.

The desired density distribution may be obtained either by having lower density in the middle at first and letting the outside high-density region move in, or by having a flat density distribution initially and letting the hot plasma expand against the cold part.

In the first method, a cylinder made of solid hydrogen or of metallic hydride is filled with hydrogen gas at, say, a few atmospheric pressures. The voltage is applied between the electrodes to start a discharge. The energy flux to the wall will produce hydrogen gas at the wall. When the desired distribution is obtained the electron beam is injected.

In the other method, the cylinder is filled with hydrogen gas at a high pressure, for example several hundred atmospheres. An electron beam is injected in the gas, which ionizes and heats the gas. The plasma expands thus creating the desired density distribution.

In both cases, an electron beam is injected in the plasma. A conceptionally simple method is to inject the beam through a thin foil. However, it may be possible to do without the foil by applying a high voltage to the cathode. The cathode is preferably designed so that the electron emission saturates at a given current density. Then the plasma current cannot increase when a high voltage is applied to the electrodes. A large voltage will appear across the cathode sheath and accelerate the electrons to a high energy.

The particular design uses a main power supply 18 that has a stored energy of about 100 kilojoules. According to Equation (28), the size of the plasma cylinder for the break-even condition is a radius of 3 mm and a length of 1 cm, if the plasma density in the hot region is $10^{26}$ m$^{-3}$ at 5 keV. The relevant parameters are $\omega_{pe} = 5 \times 10^{115}$ sec$^{-1}$, $\lambda_D = 0.6 \times 10^{-7}$ m, $v_e = 4 \times 10^7$ m/sec and $\tau_E = 3.2$ $\mu$sec. The beam energy $W_b$ is given by Equation (40) and is preferably about 750 keV. The beam current is $4 \times 10^4$ amp and the beam loading is about 37Ω. The plasma turbulent resistance is $7 \times 10^{-2}$ Ω. The magnetic field is 2 T and the electron cyclotron frequency $\Omega_e$ is $3.2 \times 10^{11}$ sec$^{-1}$, which is much smaller than the plasma frequency. It will produce $10^{16}$ D-T neutrons, if half the volume becomes hot. For a deuteron plasma, the number of neutrons is about $10^{14}$ per shot. The apparatus then operates in the manner hereinbefore described with respect to the embodiments shown in the drawings.

From the foregoing description, it should be understood that an improved method and apparatus has been described which uses electron turbulence for thermally insulating a plasma so that thermonuclear temperatures can be approached.

While preferred embodiments of the present invention have been illustrated and described, various modifications and alternatives will become apparent to those skilled in the art and, accordingly, the scope of the present invention should be defined only by the appended claims and equivalents thereof.

Various features of the invention are set forth in the following claims.

What is claimed is:

1. Apparatus for use in approaching thermonuclear temperatures using turbulent thermal insulation comprising:

a hollow cylinder comprised of a metallic hydride, said cylinder having a predetermined inside diameter and length;

an outer metallic cylinder encapsulating said hollow cylinder to thereby seal the same;

said hollow cylinder being filled with a gaseous mixture of hydrogen isotopes having an atomic weight in excess of one at a pressure of about 1.5 atmospheres;

means for producing an electric current through said outer metallic cylinder for vaporizing the same and produce a plasma within said hollow cylinder; and, means for introducing an electron beam into the plasma.

2. Apparatus as defined in claim 1 wherein the inside diameter of said hollow cylinder is about 6 millimeters and the length is about 1 centimeter.

3. Apparatus as defined in claim 1 wherein said metallic hydride is lithium deutride.

4. Apparatus as defined in claim 1 wherein said metallic cylinder is comprised of lithium.

5. Apparatus as defined in claim 1 wherein said electric current producing means comprises a power supply applied across the ends thereof, said power supply providing at least about 5 kilojoules of energy at a voltage of about 50,000 volts for a period of at least about 100 nanoseconds.

6. Apparatus as defined in claim 1 wherein said gaseous mixture is comprised of deuterium and tritium.

7. Apparatus as defined in claim 1 wherein said electron beam introducing means comprises a second power supply applied across the end portions of said plasma, said power supply providing about 100,000 joules of energy at a voltage of about 600,000 volts for a period of a few microseconds.

8. Apparatus as defined in claim 1 wherein one of the end portions of said outer metallic cylinder may comprise a thin flat metallic foil member adjacent the end of said hollow cylinder to enclose the same, said foil member being inside said outer metallic cylinder and having an annular insulator on the opposite side of said foil member and a cathode located adjacent said insulator, said electron beam introducing means being connected to said cathode.

9. Apparatus as defined in claim 8 wherein said electric current producing means is connected to said outer metallic cylinder and said cathode is in contact with said insulator and out of contact with said outer metallic cylinder.

10. A method of thermally insulating a plasma for a predetermined period of time using electron turbulence for the purpose of producing neutrons, comprising the steps of:

firing a first power supply across the ends of a hollow hydrogen cylinder, said cylinder having a predetermined inside diameter and length and containing hydrogen gas at a predetermined pressure within the range of about one and about three atmospheres, the firing causing an electric current to flow through said cylinder and vaporize the same and produce a plasma; and, firing a second power supply across said plasma to inject an electron beam therein.

11. A method as defined in claim 10 wherein said hollow hydrogen cylinder is comprised of solid hydrogen.

12. A method as defined in claim 10 wherein said predetermined inside diameter is about 6 millimeters and said predetermined length is about 1 centimeter.

13. A method as defined in claim 10 wherein said hollow hydrogen cylinder is comprised of metallic hydride.

14. A method as defined in claim 10 wherein said second power supply has a stored energy of about 100,000 joules and is applied at a voltage of about 600,000 volts for a period of a few microseconds.

15. A method as defined in claim 10 wherein said predetermined period of time is long enough to satisfy the Lawson criterion of $n\tau \geqslant 10^{14}$ cm$^{-3}$ sec.

16. A method as defined in claim 10 wherein said first power supply has a stored energy of about 5,000 joules and is applied at a voltage of about 50,000 volts for a period of about 100 nanoseconds.

17. A method of thermally insulating a plasma for a predetermined period of time using electron turbulence for the purpose of producing neutrons comprising the steps of:

filling a hollow cylinder of a predetermined inside diameter and length with hydrogen gas at a high pressure; and, thereafter firing an electron beam producing power supply to inject an electron beam in the hydrogen gas to produce an expanding plasma.

18. A method as defined in claim 17 wherein said predetermined period of time is sufficiently long to produce a substantial amount of neutrons or satisfies the Lawson criterion of $n\tau \geqslant 10^{14}$ cm$^{-3}$ sec.

19. A method as defined in claim 17 wherein said high pressure is about several hundred atmospheres.

20. A method as defined in claim 17 wherein said predetermined inside diameter is about 6 millimeters and said predetermined length is about 1 centimeter.

21. A method as defined in claim 17 wherein the step of filling the cylinder with hydrogen gas at high pressure further comprises firing a first power supply across the ends of said cylinder having hydrogen gas therein at a pressure of about 1 to about 3 atmospheres, the firing being effective to produce said high pressure.

* * * * *

UNITED STATES PATENT AND TRADEMARK OFFICE

CERTIFICATE OF CORRECTION

PATENT NO. : 4,035,656

DATED : July 12, 1977

INVENTOR(S) : Tihiro Ohkawa

It is certified that error appears in the above-identified patent and that said Letters Patent are hereby corrected as shown below:

Col. 4, line 25 "pocket" should be --packet--.

Col. 4, line 31, Equation (11) "$\tilde{\nu}$" should be --$\tilde{\nu}_i$--.

Col. 6, lines 33-34 "to a plasma" should be --in a plasma--.

Col. 6, line 39 "$\lambda$" should be --$\gamma$-- (two instances).

Col. 6, line 41 The following incomplete sentence was printed in error and should be deleted: "As the amplitude of waves grows, nonlinear electron density."

Col. 6, line 67 "=" should be --$\approx$--.

Col. 8, line 63 "$10^{115}$" should be --$10^{14}$--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*